US006641138B2

(12) United States Patent
Lee

(10) Patent No.: US 6,641,138 B2
(45) Date of Patent: Nov. 4, 2003

(54) ORIGINAL JAKE AND THE PANCAKE GAME

(76) Inventor: Michael David Lee, 213 15th St., Manhattan Beach, CA (US) 90266

( * ) Notice: Subject to any disclaimer, the term of this patent is extended or adjusted under 35 U.S.C. 154(b) by 0 days.

(21) Appl. No.: 10/117,403

(22) Filed: Apr. 8, 2002

(65) Prior Publication Data

US 2003/0189289 A1 Oct. 9, 2003

(51) Int. Cl.[7] ..... A63F 3/00
(52) U.S. Cl. ..... 273/242; 273/249
(58) Field of Search ..... 273/236, 243, 273/249, 248, 242, 256

(56) References Cited

U.S. PATENT DOCUMENTS 3,594,002 A * 7/1971 Glass
4,032,154 A * 6/1977 Magiera ..... 273/256
5,190,292 A * 3/1993 Perry ..... 273/256
5,318,304 A * 6/1994 Reppas ..... 273/244
5,342,058 A * 8/1994 Giovannetti ..... 273/243
5,388,835 A * 2/1995 Albright ..... 273/249

* cited by examiner

*Primary Examiner*—Benjamin H. Layno
*Assistant Examiner*—V Mendiratta

(57) ABSTRACT

The Original Jake and the Pancake Game, a family oriented board game, is presented which consists of a game board having a path of progression of playing positions around the board, a Jake figurine for each player, playing cards to determine the progression, if any, of the figurines, a spinner to determine the reward or penalty for landing on certain playing positions, replica pancakes which are distributed to players as rewards, a grill for storage of the pancakes and a spatula to scoop the pancakes from the grill.

1 Claim, 5 Drawing Sheets

Game Board

Figure 1 Game Board
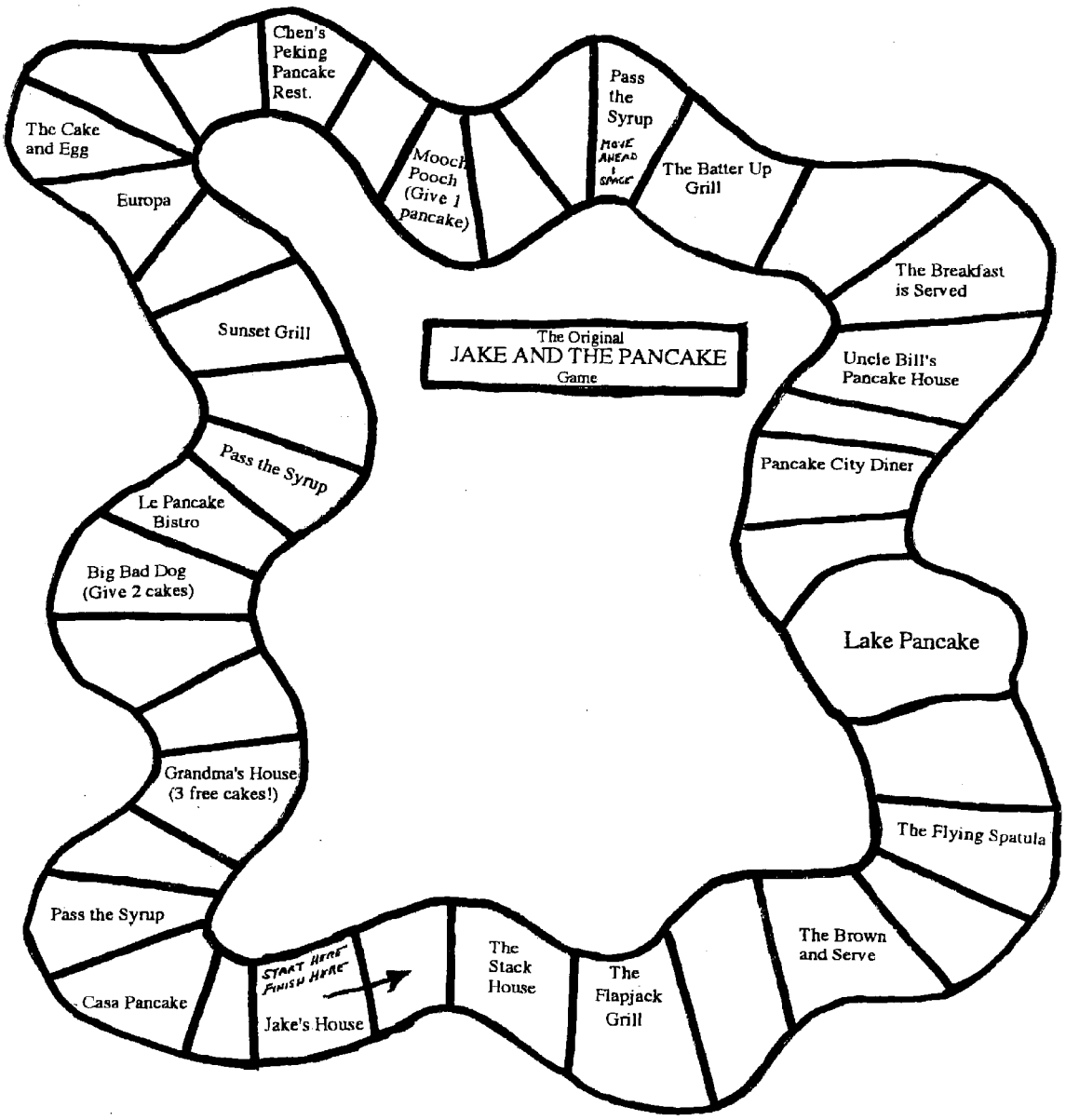

Figure 2 Game Cards
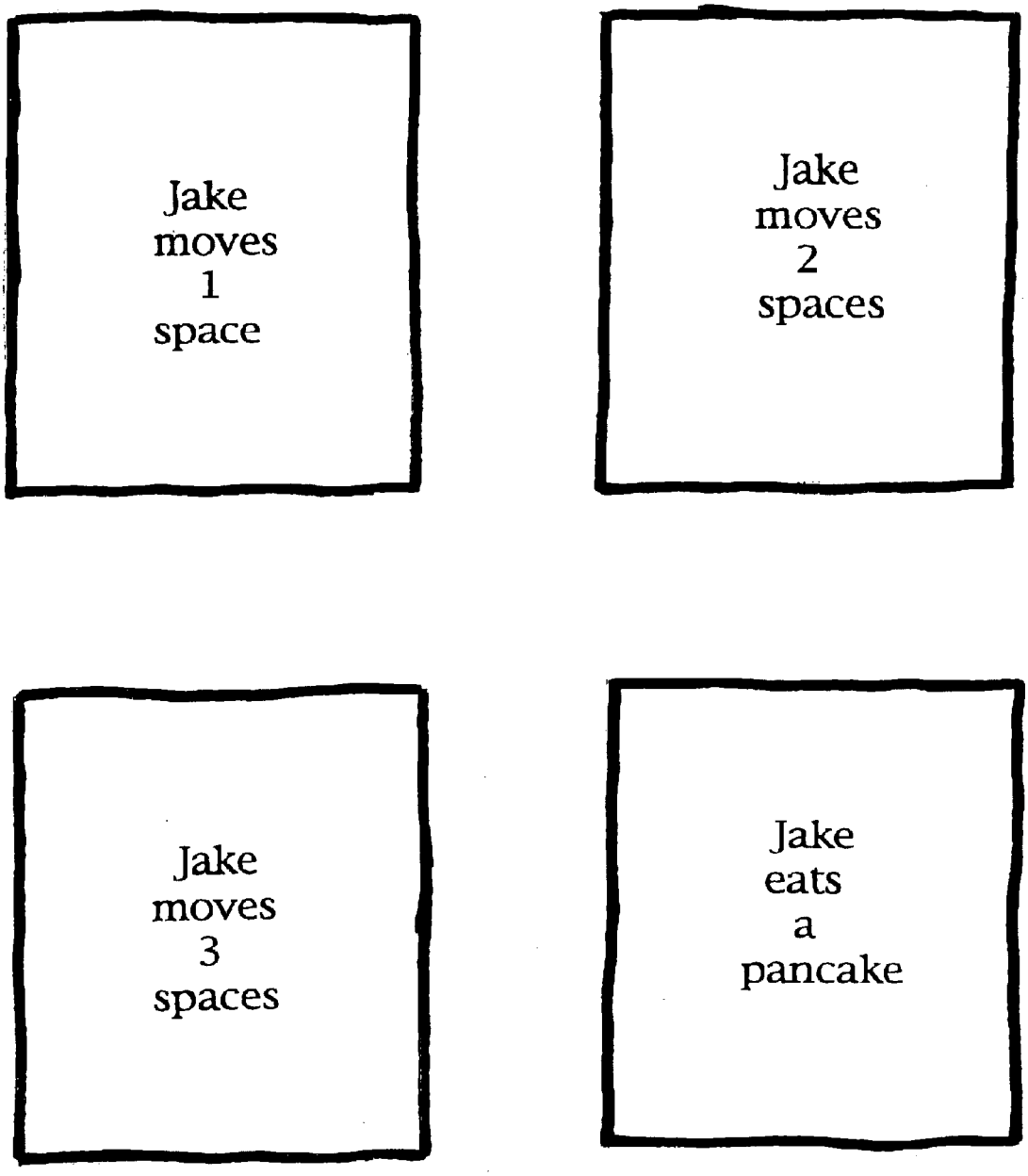

Figure 3 Spinner
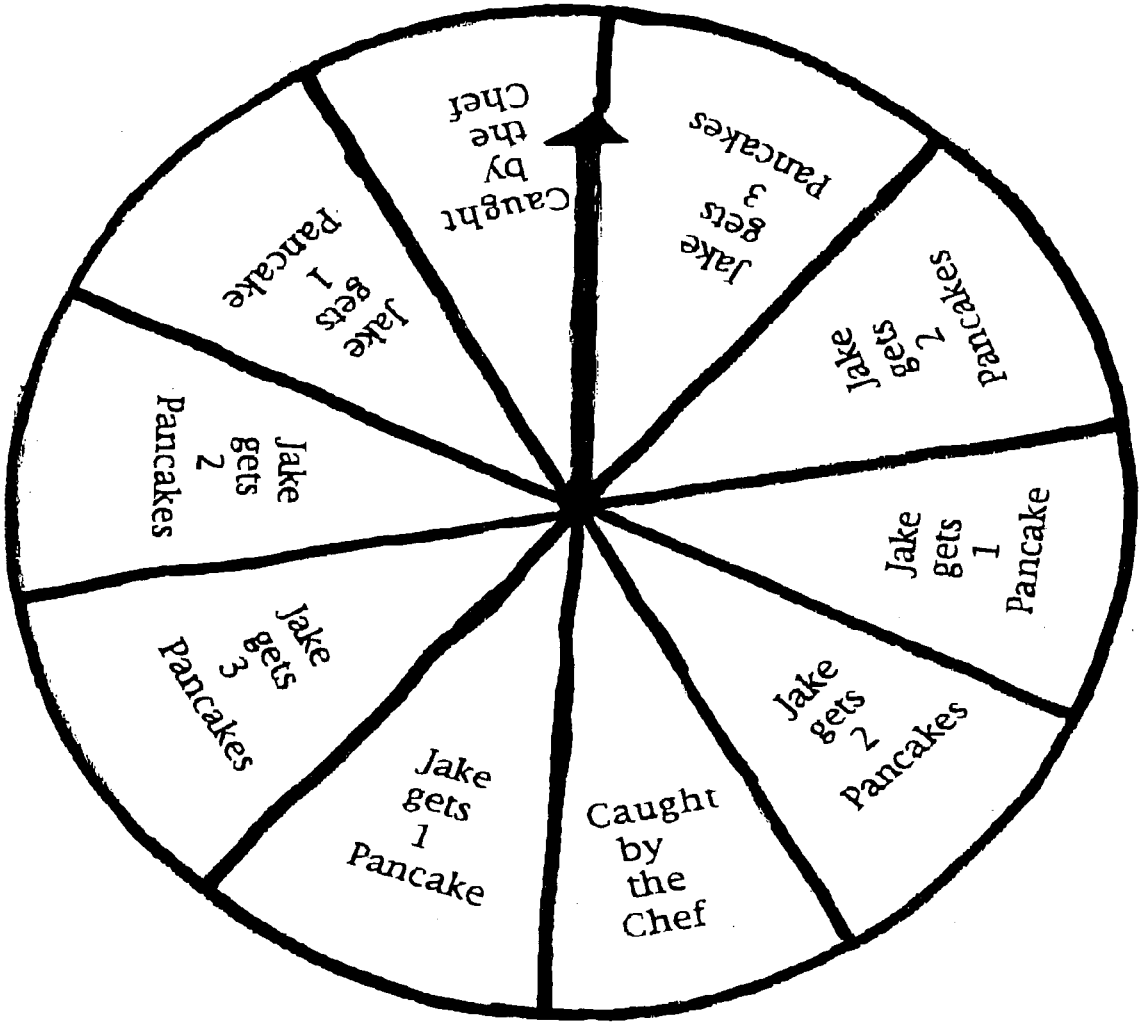

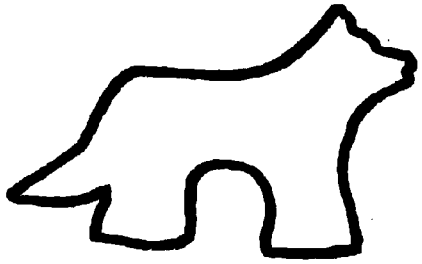
Figure 4 Jake Figurine
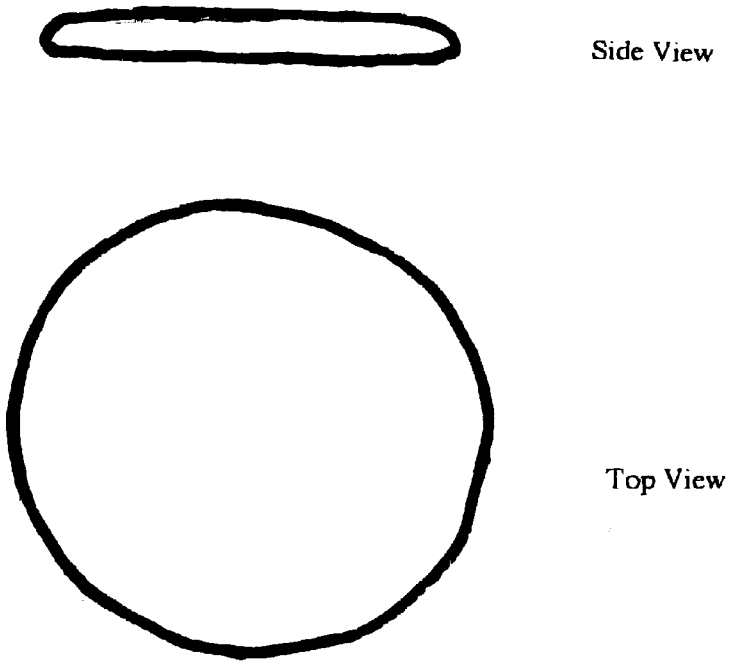
Figure 5 Pancake

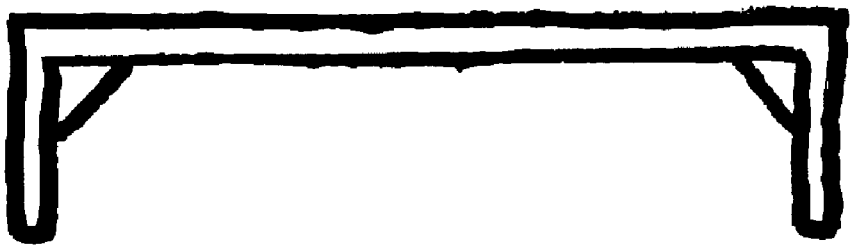
Figure 6 Grill
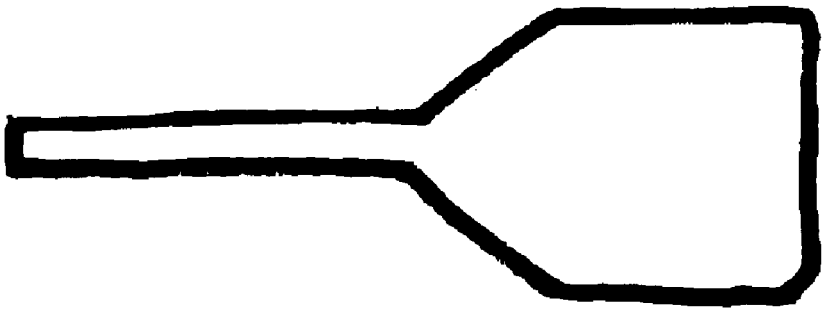
Figure 7 Spatula

ORIGINAL JAKE AND THE PANCAKE GAME

CROSS REFERENCES TO RELATED APPLICATIONS U.S. PATENT DOCUMENTS

Not Applicable

STATEMENT OF FEDERALLY SPONSORED RESEARCH/DEVELOPMENT:

Not Applicable

REFERENCE TO A SEQUENCE LISTING, A TABLE, OR A COMPUTER PROGRAM LISTING COMPACT DISC APPENDIX:

Not Applicable

BACKGROUND OF THE INVENTION

The invention relates generally to board games and specifically to a family oriented game, based on the theme of the inventor's published book, that enables adults and children (ages 4 and up) to interact. Many board games have been created in the period art that include playing pieces, playing cards and spinners, For example, U.S. Pat. No. 5,342,058 to Giovanetti, U.S. Pat. No. 5,190,292 to Perry, U.S. Pat. No. 3,594,002 to Glass, U.S. Pat. No. 5,318,304 to Reppas, U.S. Pat. No. 5,388,835 to Albright and U.S. Pat. No. 4,032,154 to Magieri are all examples of such prior art. While these inventions may satisfy the particular purpose for which they were created, they would not be suitable for the purpose of this invention which is to provide a family oriented game that is simple for children (ages 4 and up) to play with adults or with other children and which is based on the inventor's published book.

BRIEF SUMMARY OF THE INVENTION

A primary object of the invention is to provide an entertaining, family oriented game that is simple for children (ages 4 and up) to play with adults or with other children developed around the theme of the inventor's published book, "Jake and the Pancake", and that will overcome the shortcomings of the prior art devices.

Another object is to provide a game of chance where the player assumes the role of "Jake", a little dog trying to navigate the path of the game board while avoiding being caught while accumulating pancakes. The player who completes the game board path with the most pancakes wins.

This invention will be embodied in the form illustrated in the accompanying drawings, however it should be noted that drawings are presented for illustration purposes only.

BRIEF DESCRIPTION OF THE DRAWINGS

The figures in the drawings are briefly described as follows:

FIG. 1 is the Game Board

FIG. 2 is the Game Cards

FIG. 3 is the Spinner

FIG. 4 is the Jake figurine

FIG. 5 is the Pancake

FIG. 6 is the Grill

FIG. 7 is the Spatula

DETAILED DESCRIPTION OF THE INVENTION

The preferred embodiments of the invention is evidenced by the accompanying drawings illustrating The Original Jake and the Pancake Game which consists of a game board (FIG. 1) with a path of progression of playing positions in which some playing positions represent rewards/ penalties and some represent restaurants which allow the player to spin for rewards/ penalties; a plurality of Jake figurines (FIG. 4) which players move around the game board to evidence their playing position; a plurality of game cards (FIG. 2) to determine the extent of progression around the game board; a spinner (FIG. 3) to determine the reward/ penalty for landing on certain playing positions; a plurality of replica pancakes (FIG. 5) which are distributed to players as rewards; a grill (FIG. 6) for storage of the pancakes; and a spatula (FIG. 7) to scoop the pancakes from the grill. A primary object of the game is to provide an entertaining, family oriented game that is simple for children (ages 4 and up) to play with adults or with other children developed around the theme of the inventor's published book, "Jake and the Pancake". Another object of the game is for each player to assume the role of Jake, a little dog trying to navigate the path of the board game while avoiding being caught while accumulating pancakes. The player who completes the game board path with the most pancakes wins. Game instructions are as follows:

Rules

All players start at Jake's house and move around the board/restaurant row drawing from the stack of game cards. Players take turns, drawing cards and spinning a spinner. Each player must move his/her Jake figurine all the way around the board and finish at Jake's house. Each player has his or her own Jake figurine to move around the board counter-clockwise.

TO START:

Place Jake figurines on start line at lake's house. Youngest player goes first. A player draws a card to determine how many spaces to move their Jake figurine. Cards say, Jake Moves 1 space/Jake Moves 2 spaces, etc. If player draws a "Jake Eats A Pancake" card, he/she surrenders one pancake to the grill. If figurine lands on a restaurant, player spins the Spinner to see if Jake gets any pancakes or is caught by a chef.

Wherever the spinner needle stops determines the number of pancakes Jake swipes from the restaurant he has landed on. For example: Say a player lands on the Pancake City Diner. The player spins the spinner. The needle stops on 3 pancakes. Player gets 3 pancakes from the grill. If the needle stops on a Chef, Jake has been caught in the act of Grand Theft Pancake. Player must surrender any pancakes he/she has collected and put them back on the grill. If player has no pancakes when spinner needle stops on a Chef or Jake Eats A Pancake, there's no penalty. Next player takes his/her turn and draws a card. All pancakes are collected from the grill. When you receive pancakes (after spinning) you may use the spatula for collecting them. When you surrender pancakes you put them back on the grill. For fun, stack pancakes as Jake gets ' em! Players take turns drawing a card and spinning the spinner when appropriate.

KEY NOTES

First player to get Jake around the board and home gets a free Short Stack of pancakes (2). *Winner is the player who gets lake home with the MOST pancakes!

HAZARDS

Lake Pancake—Soggy pancakes! if Jake lands in Lake Pancake player surrenders any pancakes he/she has. Put them back on the grill. Bummer for Jake! Mooch Pooch—If Jake lands on the Mooch Pooch player must surrender a pancake to the pooch (bummer, but at least a gesture of goodwill). Big Bad Dog—If Jake lands on the Big Bad Dog player must surrender 2 pancakes. (He's a meanie so fork 'em over.

COOL STOPS

Grandma's House- Grandma loves Jake! If lake lands on Grandma's house player gets a free stack of pancakes (3)! Pass The Syrup—If Jake lands on Pass The Syrup player moves ahead one free space (that's one space closer to getting Jake home!).

RULES FOR FINISH

All players must finish at Jake's house. If a player draws a card that lands beyond lake's house he/she can give up a pancake(s) to get him home. How? You just do a little subtraction. Subtract the space(s) you are from Jake's house from the number of spaces you got on your spin. Example: Say you're 2 spaces from Jake's house. You spin 'Jake Moves 3 Spaces.' You could give up 1 pancake (3–2=1) to get him home. If you don't want to do that you can wait until your next turn to try to draw a card and get the exact number Of spaces you need to get Jake home. (Note: If you're the last to finish you only get 2 attempts to get the exact number. The second draw would be final).

And remember: the first player to get Jake home gets a free short stack (2 pancakes) so sometimes it's worth doing some subtraction to get Jake home! Once you reach Jake's house you're finished. Others continue to draw cards and spin until everyone gets their Jake home.

When everyone gets their Jake home, count up the pancakes and the player with the most wins!

What is claimed is:

1.A family oriented board game of chance for adults and children (ages 4 and up) derived from the inventor's published book, wherein each player assumes the role of "Jake", a little dog trying to avoid being caught while in pursuit of pancakes, which comprises:

a) a game board having a path of progression of playing positions, in which some playing positions represent rewards/=penalties and some represent restaurants which allow the player to spin for rewards/penalties;

b) a plurality of Jake figurines which players move around the game board to evidence their playing position;

c) a plurality of game cards to determine the extent of progression around the game board;

d) a spinner to determine the reward/ penalty for landing on certain playing positions;

e) a plurality of replica pancakes which are distributed to players as rewards;

f) a grill for storage of the pancakes; and g) a spatula to scoop the pancakes from the grill.

* * * * *